United States Patent [19]

Colognori

[11] 4,190,091

[45] Feb. 26, 1980

[54] SCREW, SCREWDRIVER AND SCREW-HOLDING ATTACHMENT THEREFOR

[75] Inventor: Aldo Colognori, 69 Lawton Ave., Cliffside Park, N.J. 07010

[73] Assignees: Sebastian Zuppichin, Cliffside Park; Aldo Colognori, Cliffside, both of N.J.

[21] Appl. No.: 945,811

[22] Filed: Sep. 26, 1978

[51] Int. Cl.[2] ..... B25B 15/00; B25B 23/10

[52] U.S. Cl. ..... 145/52; 145/50 A; 145/50 D

[58] Field of Search ..... 145/50 A, 50 D, 50 DB, 145/52, 50 E; 85/45

[56] References Cited

U.S. PATENT DOCUMENTS

| | | | |
|---|---|---|---|
| 914,174 | 3/1909 | North | 145/52 |
| 942,742 | 12/1909 | Presson | 145/52 |
| 1,889,330 | 11/1932 | Humes et al. | 145/52 |
| 1,925,385 | 9/1933 | Humes et al. | 145/52 |
| 2,579,438 | 12/1951 | Longfellow | 145/50 D |
| 2,902,071 | 9/1959 | La Pointe et al. | 145/52 |
| 2,905,215 | 9/1959 | Hlynsky | 145/52 |

FOREIGN PATENT DOCUMENTS

| | | | |
|---|---|---|---|
| 126612 | 2/1948 | Australia | 145/50 A |
| 10612 | 8/1880 | Fed. Rep. of Germany | 50 A/ |
| 362860 | 11/1922 | Fed. Rep. of Germany | 145/50 D |
| 523088 | 4/1931 | Fed. Rep. of Germany | 52/ |
| 2338412 | 8/1977 | France | 85/45 |
| 710062 | 6/1966 | Italy | 145/50 F |
| 369415 | 6/1963 | Switzerland | 145/52 |

*Primary Examiner*—Othell M. Simpson
*Assistant Examiner*—J. T. Zatarga
*Attorney, Agent, or Firm*—Kirschstein, Kirschstein, Ottinger & Cobrin

[57] ABSTRACT

A screwdriver has an undercut enlarged foot portion and an anti-shift pivot element of one-piece therewith. The screwdriver is longitudinally inserted into a screw such that the foot portion and the pivot element are respectively received with clearance in an undercut slot and a central cavity formed in the screw head. Rotation of the screwdriver about the pivot element causes the foot portion to slide partially underneath and grippingly engage the side walls of the slot. A screwholding attachment is adjustable in fine, continuous manner relative to the screwdriver.

3 Claims, 8 Drawing Figures

SCREW, SCREWDRIVER AND SCREW-HOLDING ATTACHMENT THEREFOR

BACKGROUND OF THE INVENTION

1. Field of the Invention

The present invention generally relates to screw constructions, screwdriver constructions, and attachments for such screwdrivers for firmly holding such screws to thereby prevent mutual slipping.

2. Description of the Prior Art

The conventional screwdriver for inserting or removing a screw has not proven to be altogether adequate, particularly in cases where the screw exhibits resistance to turning. One common problem associated with conventional screwdriver constructions is that the screwdriver blade slips upwardly and/or outwardly out of the slot in the screw head. This may mar the outer surface of the screw and is evidently highly undesirable, particularly in industrial applications.

Moreover, complex screw-holding attachments for screwdrivers have been proposed which are operative for holding a screw while driving the same with a screwdriver. It has been proposed to shift such attachments lengthwise along the screwdriver in a coarse manner, i.e. manually sliding such attachments in lengthwise direction. Additionally, the known complex attachments are comprised of a great number of discrete parts, each part being prone to being mislaid. Consequently, such attachments have not proven to be altogether reliable in operation, nor satisfactory in practice.

SUMMARY OF THE INVENTION

1. Objects of the Invention

Accordingly, it is the general object of the present invention to overcome the aforementioned drawbacks of the prior art.

An object of this invention is to modify the screw head and the screwdriver blade to make then perform better when used on difficult-to-turn screws.

Another object of this invention is to transmit torque to the screw head which is greater than that transmitted by conventional screwdrivers.

Still another object of this invention is to prevent slipping and shifting of the screwdriver blade out of the screw head slot during insertion or removal of a screw.

A further object of this invention is to firmly grip a screw with a screwdriver attachment in a restricted area where it is difficult to hold the screw with one hand while the screwdriver is being operated.

An object of this invention is to provide a highly reliable construction of great strength, but of extreme simplicity and durability.

Another object of this invention is to provide a screwdriver which is efficient in use in providing positive and safe driving engagement without risk of slipping, with transmission of maximum torque, and in the case of screws, without preventing use of a conventional flat blade.

Still another object of this invention is to provide a particular and novel driving tool which is simple in its construction and which is adapted to be used with a particular and novel screw of the type herein disclosed.

Another object of this invention is to provide a screw-holding attachment which is adapted to be used readily and efficiently in conjunction with a novel driving tool and a novel screw.

A further object of this invention is to minimize the number of parts in screw-holding screwdriver attachments.

2. Features of the Invention

In keeping with these objects and others which will become apparent hereinafter, one feature of the invention resides, briefly stated, in a novel screw construction, which comprises a threaded screw body having a longitudinal screw axis of symmetry, and screw head having wall means bounding a driver-engaging recess in the head. The wall means includes a pair of opposite undercut side walls and respective wall edges at the top of the head. The wall edges extend transversely over the entire width of the head in generally parallel relationship to each other, and the wall edges are spaced apart of each other at a predetermined transverse spacing to thereby form an open end at the top of the head. The wall means also includes a bottom wall which together with the undercut side walls forms an undercut slot which extends over the entire width of the head. The wall means further includes a longitudinally-extending cavity which communicates with the undercut slot at the bottom wall. This cavity has a cross-sectional dimension which extends transversely across the bottom wall for a distance less than the entire width of the head.

In further accordance with the present invention, a novel screwdriver construction is embodied in an elongated driver shank having a longitudinal shank axis, a handle end region and an opposite blade end region. The screwdriver also comprises a driver blade of one-piece with the blade end region of the shank. The blade includes an undercut enlarged foot portion receivable in the aforementioned slot, the foot portion having an axial end face, a pair of opposite major foot surfaces and a transverse thickness dimension between the latter at the axial end face, as measured in a plane substantially normal to the longitudinal axis. The driver blade also includes an anti-shift pin element of one-piece with and located axially adjacent to the undercut foot portion. The element projects from the axial end face in direction away from the handle end region along a pivot axis which is co-linear with the shank axis.

The combination of the screw and screwdriver is very advantageous because the foot portion is readily insertable in longitudinal direction directly into the screw slot due to the fact that the transverse thickness dimension at the end face of the undercut foot portion is of less magnitude than the predetermined transverse spacing of the open end of the screw head. At the same time, the anti-shift element is advantageously longitudinally received in the cavity for limited turning movement relative to the latter about the pivot axis. The element not only serves to prevent lateral slipping or displacement of the blade from the slot, particularly during the turning of screws which are difficult to turn, but also serves as a pivot element for reliably turning the foot surfaces of the foot portion into torque-transmitting engagement with the undercut side walls of the slot. Specifically, the foot surfaces slide partially underneath and grippingly engage the side walls of the slot when the driver blade turns the element about the pivot axis.

In still further accordance with the present invention, a screw-holding attachment comprises means for holding a screw to be turned by the driver blade. The holding means includes a pair of movable resilient arms at opposite sides of the driver shank, with each arm including a semi-cylindrical body portion, and a screw-gripping end portion having a plurality of curved fingers which extend in smooth, continuous manner both longitudinally away from the handle end region and inwardly towards the longitudinal axis, to thereby form a generally semi-dome shaped configuration. The resilient arms are moved between a non-gripping position in which the arms are spaced apart of each other, and a gripping position in which the fingers form a dome-shaped configuration, and substantially encloses the screw head of the screw to be turned, by a locking sleeve which is slidably mounted over the resilient arms for movement lengthwise of the latter.

The screw-holding attachment further comprises means for finely and continuously adjusting the position of the holding means in longitudinal direction relative to the shank. This fine-adjusting means includes a mounting collar which surrounds the arms and which is fixedly connected to the latter for longitudinal movement with the arms, and a longitudinally-extending mating threaded shank portion which is fixedly connected to the shank for turning movement with the same. The collar has a longitudinally-extending threaded collar portion which threadedly engages the mating shank portion for shifting the shank relative to the holding means with infinitely variable displacement. The features of fixedly securing the mounting collar directly to the arms, and of fixedly securing the threaded shank portion on the shank are particularly advantageous, because they make for a simple construction having but a few separate parts. As noted above, some prior art constructions disclose screwdriver attachments having a considerable number of discrete parts, with each such part being easily prone to being misplaced or lost—a drawback overcome by the present invention.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
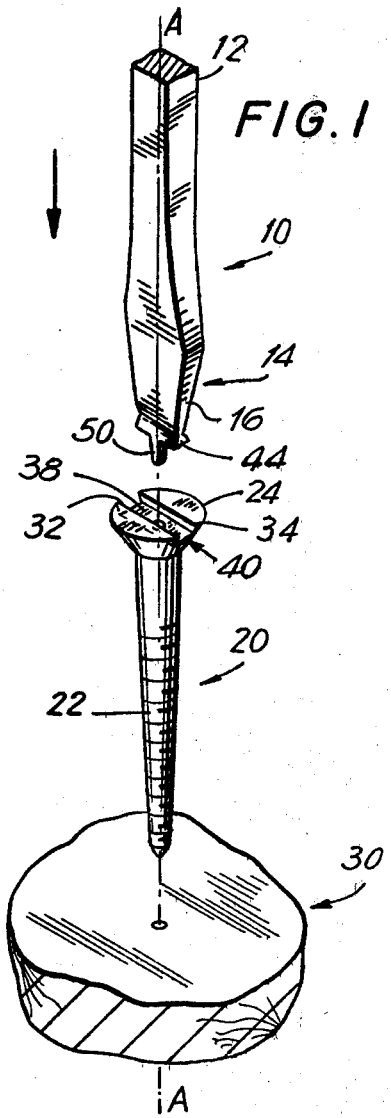
FIG. 1 is a broken-away, exploded view of the novel screw and screwdriver combination in accordance with the present invention.
Figure 2:
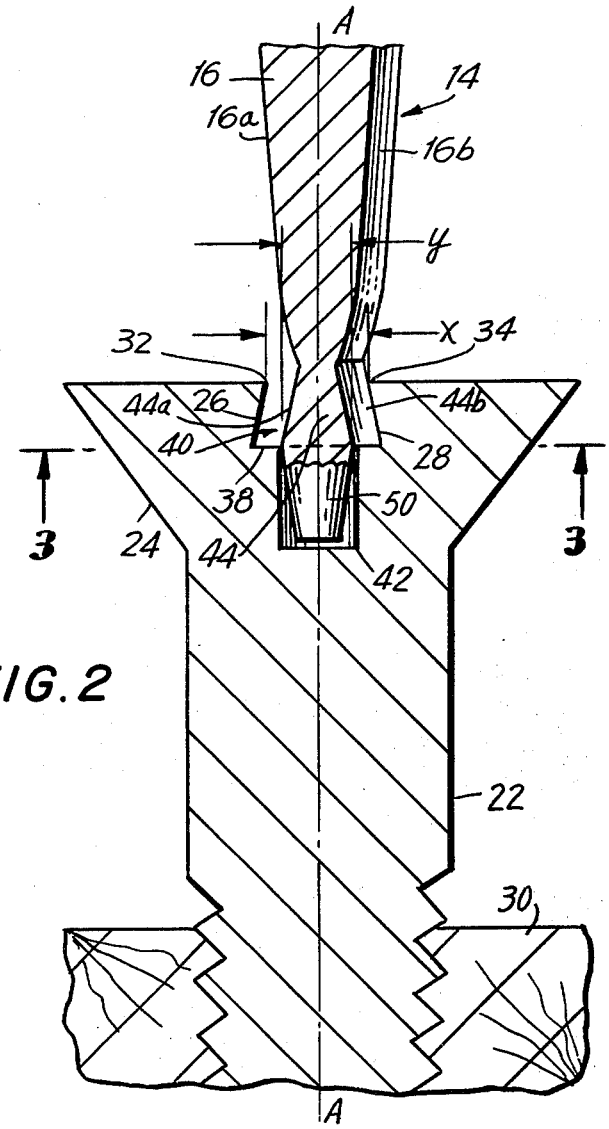
FIG. 2 is an enlarged sectional view of the combination of FIG. 1 with the screwdriver blade slightly turned in the screw slot.
Figure 3:
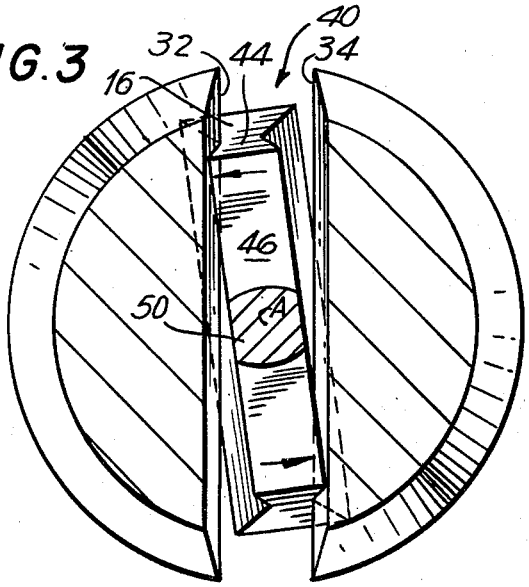
FIG. 3 is a cross-sectional view of the combination as taken along line 3—3 of FIG. 2.
Figure 5:
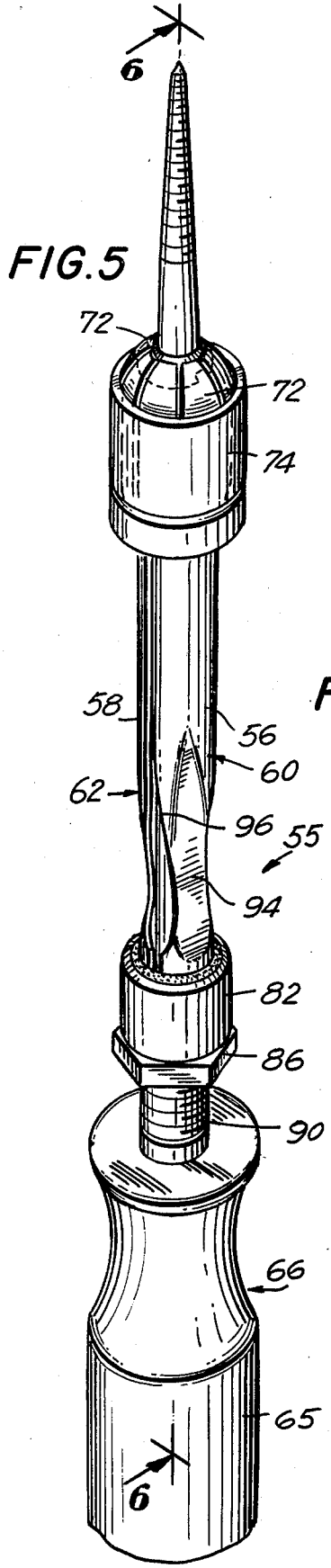
FIG. 5 is a broken-away perspective view of the novel screw-holding attachment for a screwdriver in accordance with the present invention.
Figure 6:
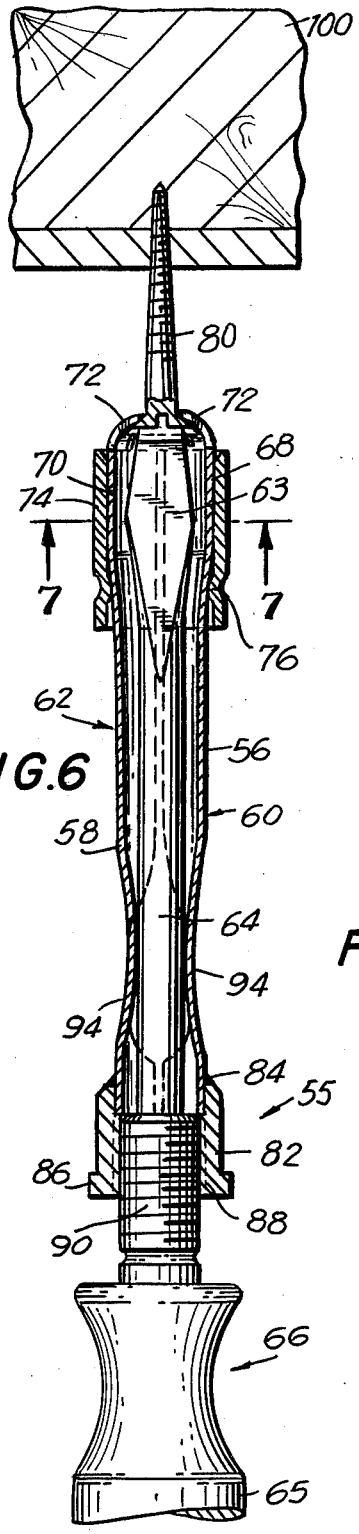
FIG. 6 is a sectional view of the attachment of FIG. 5 with a screw partially driven into an object.

Referring now to the drawings, reference numerals 10, 20, 30 in FIG. 1 generally respectively identify a novel screwdriver, a novel screw, and an object into which the screw is to be turned by the screwdriver blade. As best shown in FIGS. 1–3, the screw 20 includes a screw body 22 having a longitudinal screw axis of symmetry A—A, and a screw head 24 on the screw body 22.

The screw head 24 is formed with a pair of opposite undercut side walls 26, 28 and, at the top of the head, wall edges 32, 34 extend transversely over the entire width of the head in generally parallel relationship to each other. The wall edges are spaced apart of each other at a predetermined transverse spacing x to thereby form an open end at the top of the head 24. The undercut side walls 26, 28 are inclined relative to each other and extend from the wall edges 32, 34 into the head in radially outward direction relative to axis A—A. The side walls 26, 28 are preferably planar and bound a dovetail slot 40 with the substantially planar bottom wall 38. The dovetail slot 40 extends over the entire width of the screw head.

A cavity 42 extends longitudinally into the screw and has an open end which communicates with the slot 40 at the bottom wall 38. The cavity 42 has a cross-sectional dimension which extends transversely across the bottom wall for a distance less than the entire width of the head. Put another way, the screw has lateral wall portions which bound the cavity 42. Cavity 42 is preferably equi-distantly located from the opposite ends of the elongated slot 40. The cross-sectional configuration of the cavity 42 may be circular as illustrated, or may be of any geometrical configuration.

Turning now to the screwdriver 10 of FIGS. 1–3, it comprises a driver shank 12 having a longitudinal shank axis which is co-linear with the screw axis when the screwdriver is longitudinally inserted into the screw head in the manner shown by the arrow in FIG. 1. The shank 12 has an upper non-illustrated handle end region at which a screwdriver handle is mounted, and a lower blade end region. A driver blade 14 is of one-piece with the blade end region of the shank. Blade 14 preferably includes a generally converging main blade portion 16 having a pair of opposite major tapered surfaces 16*a*, 16*b*, and a transverse thickness dimension between the latter, as measured in a plane substantially perpendicular to the axis A—A, which decreases in smooth, continuous manner in direction away from the handle end region.

Blade 14 also includes an undercut foot portion 44 of one-piece with and located axially adjacent to the converging portion 16. Foot portion 44 has an axial end face 46, a pair of opposite major foot surfaces 44*a*, 44*b*, and a transverse thickness dimension y between the latter at the end face 46, as measured in a plane substantially perpendicular to the axis. Each foot surface 44*a*, 44*b* is substantially planar and inclined relative to axis A—A. The foot surfaces are flared in direction away from the handle end region in radially outward direction such that the transverse thickness of foot portion 44 increases in smooth, continuous, and preferably linear manner to thereby form the foot portion with a wedge-like configuration. The thickness of the foot portion is at a minimum value at the thinnest thickness dimension of the converging portion 16, and at a maximum value at the end face 46.

Blade 14 further includes an anti-shift element or pin 50 of one-piece with and located axially adjacent to the foot portion 44. Pin 50 projects from the end face 46 away from the handle end region along a pivot axis which is co-linear with the axis A—A. Whereas foot portion 44 extends over the entire width of the blade, the pin 50 has a width dimension less than the entire blade width. The pin 50 is preferably equi-distantly located from the opposite ends of the elongated foot portion. The configuration of the pin 50 need not be a generally tapered cylinder as shown, but may be of any geometrical configuration including a parallelepiped.

In accordance with the present invention, the transverse thickness dimension y at the end face 46 of the foot portion 44 is of less magnitude than the predetermined transverse spacing x at the open end. This feature permits longitudinal insertion of the undercut foot portion 44 through the open end of the slot 40 for reception in the latter with clearance. Due to this relative dimensioning, the foot portion has freedom of limited angular turning movement about the axis when the blade is turned.

At the same time, the pin 50 is mounted in the cavity 42 for limited turning movement relative to the latter about the pivot axis. The end face 46 engages the bottom wall 38 and thereby limits the depth of insertion of the pin into the cavity. As best seen in FIG. 3, when it is desired to drive the screw, initial turning of the driver blade causes the undercut foot surfaces **44*a*, 44*b* to slide partially underneath the undercut side walls 26, 28 and grippingly engage the latter in surface-to-surface and torque-transmitting engagement. Further turning of the driver blade will force the screw body 22 into the object 30**.

Figure 4:
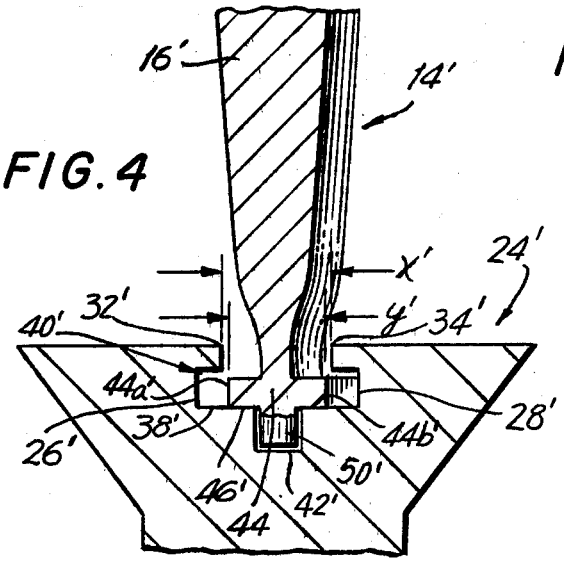
FIG. 4 is a view analogous to FIG. 2, but shows a modified screw and screwdriver combination slightly turned in the screw slot.

FIG. 4 shows a modified screw and screwdriver construction. The screw head 24' is formed with a pair of opposite undercut side walls 26', 28' and wall edges 32', 34' at the top of the head. These wall edges extend transversely over the entire head width in general parallel relationship to each other, and are spaced apart of each other at a predetermined transverse spacing x' to thereby form an open end at the top of the head. The side walls 26', 28' are not inclined relative to each other as in the case of the earlier embodiment, but instead are substantially parallel to each other to thereby form an undercut slot with a rectangular cross-section. A substantially planar bottom wall 38' bounds the slot 40', and a longitudinally-extending cavity 42' has an open end which communicates with the slot 40' at the bottom wall 38'.

Analogously, the blade 14' has a converging portion 16' which has a pair of opposite major tapered surfaces whose thickness decreases in direction away from the handle end region. The blade 14' also has an undercut foot portion 44' which includes an axial end face 46', a pair of opposite substantially planar major foot surfaces **44*a*', 44*b*', and a transverse thickness dimension y' at the axial end face 46' which is less than the transverse spacing x'. The foot surfaces 44*a*', 44*b*' extend generally parallel to each other and form the foot portion 44'** with a rectangular-shaped cross-section.

A pivot pin 50' projects from the end face 46' and is mounted for turning movement in cavity 42'. After the rectangular-shaped foot portion has been longitudinally inserted into the slot 40', concomitantly with the longitudinal insertion of the pin 50' into cavity 42', initial rotation of the driver blade causes the undercut foot surfaces to slide partially underneath the undercut side walls and to grippingly engage the latter in surface-to-surface, torque-transmitting engagement. Further turning of the driver blade will drive the screw body into the object.

Turning now to FIGS. 5–8, reference number 55 generally identifies a screw-holding attachment for a screwdriver. Attachment 55 includes a pair of movable elongated resilient arms 60, 62, each having a semi-cylindrical body portion 56, 58 at opposite sides of the driver shank 64 of the screwdriver 66. The semi-cylindrical body portions extend circumferentially about shank 64 and partially enclose the latter.

Each arm 60, 62 further includes a screw-gripping end portion 68, 70, each having a plurality of curved fingers 72 which extend in smooth, continuous arcuate manner, both longitudinally away from the handle end region 65 of the screwdriver and inwardly towards the longitudinal axis to thereby form a generally semi-dome-shaped configuration. Each set of fingers is located at opposite sides of the driver blade 63, and each semi-dome-shaped end portion extends circumferentially about the blade 63 to partially enclose the latter.

A locking sleeve 74 has a radial inwardly-extending camming-type projection or annular ridge 76. Sleeve 74 is slidably mounted over the arms 60, 62 for movement lengthwise of the latter. In use, when the sleeve 74 is slid to the end of the arms which is most remote from the handle 65, the arms assume a screw-gripping position (see FIG. 6) in which all of the fingers 72 cooperate to form a generally dome-shaped configuration which substantially encloses the head of a screw 80 to be driven. When the sleeve 74 is slid to the opposite end of the arms which is closest to the handle 65, the arms move part of each other to assume a non-screw-gripping position (see FIG. 8). The projection 76 rides along the outer surface of the arms to move the latter between the two aforementioned positions.

The opposite ends of each arm which are closest to the handle 65 are prevented from moving apart of each other by being fixedly mounted on a mounting collar 82. The collar is fixedly connected to the arms for participating in longitudinal movement with the same by weld 84, or like permanent joining techniques, or may equivalently be made of a one-piece construction. The collar 82 has a flange portion 86 which preferably is polygonally-shaped in order to facilitate manual gripping by the user.

In order to finely and continuously adjust the position of the attachment 55 lengthwise relative to the shank, the collar 82 is formed with a longitudinally-extending internally threaded collar portion or tapped passage 88, and the shank 64 is provided with a longitudinally-extending, externally-threaded shank portion or mating male threaded portion 90. Threaded shank portion 90 is fixedly mounted on the shank for turning movement with the same and may be formed of one-piece with the shank, or as a threaded cylindrical sleeve which is integrally welded to the shank. Threaded portion 90 threadedly engages the tapped passage 88 and preferably has a fine pitch in order to adjustably shift the attachment relative to the shank with infinitely variable displacement. The cooperation of the attachment 55 with a screwdriver will be described in conjunction with the novel screw and screwdriver constructions described above, although it will be understood that it is also possible to use conventional screwdrivers which are not provided with undercut foot portions or anti-shift pivot pins, and to use conventional screws which are not provided with undercut slots or with cavities.

Figure 8:
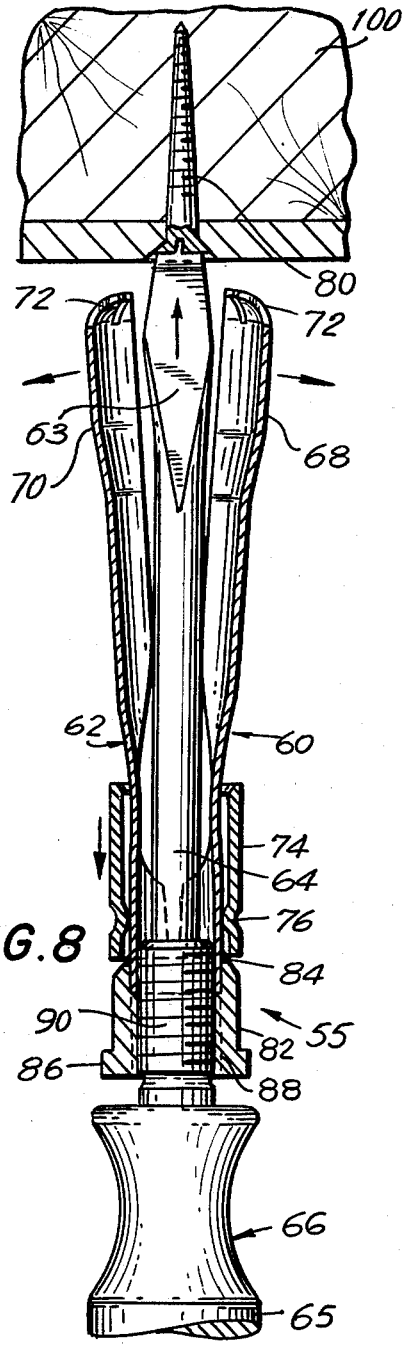
FIG. 8 is a view analogous to FIG. 6, but with the screw fully driven into the object.
Figure 7:
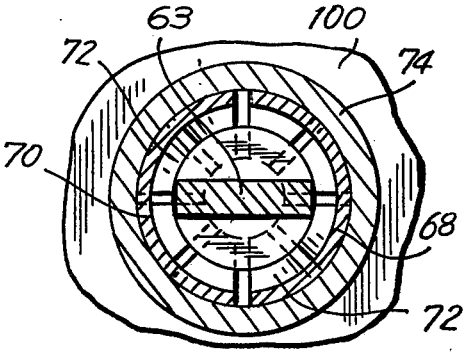
FIG. 7 is an enlarged sectional view as taken along line 7—7 of FIG. 6.

In order to drive the screw 80 into the object 100 utilizing the attachment 55, the locking sleeve 74 is initially slid away from the fingers 72, thereby permitting the resilient arms 60, 62 to move apart of each other towards the position illustrated in FIG. 8 due to their inherent resilience and due to the fact that they are pre-stressed to normally assume this non-gripping position. Preferably, the arms are made of a spring steel and are flattened at wall regions 94 which bound elongated slot 96 (only one of which is shown) and which facilitate bending of the arms towards the FIG. 8 position.

The screw 80 is now mounted on the blade 63. As described above, the pin is longitudinally inserted into the cavity and the undercut foot portion is longitudinally inserted into the undercut slot. Next, the sleeve 74 is slid back toward the fingers until it surrounds the screw-gripping portions 68, 70. The annular cam 76 pushes the arms towards each other until the fingers 72 enclose the underside of the screw head in the FIG. 6 position. The sleeve 74 is fixedly held in this position due to the tendency of the arms to spring outwardly.

The user now manually grips the polygonally-shaped flange portion 86, which need not be so shaped, but may be roughened, e.g. by knurling, in order to facilitate manual gripping. Concomitantly, the user turns the shank 64 by rotating blade 65. This turning movement causes the threaded portions 88, 90 to threadedly engage each other, and the shank 64 moves longitudinally relative to the attachment in a smooth, continuous manner.

Eventually, the underside of the screw head will be brought into locking, torque-transmitting engagement with the curved fingers 72, thereby locking the screw to the attachment and, in turn, to the shank 64. The user may now remove his hold from the flange portion 86 and drive the screw into the object 100.

Once the screw is almost fully anchored in the object 100, the locking sleeve 74 is slid back away from the fingers. It will be understood that this must be done before the screw is fully anchored, because a clearance area relative to the object 100 is needed in order to permit the screw-gripping end portions 68, 70 to clear the object and not mechanically interfere with the same.

Further rotation of the shank 64 will drive the screw 80 fully home into the object 100. Of course, another screwdriver other than the one with the attachment can be used to complete the driving operation.

A screw may be removed from an object in a reciprocal, inverted manner to that described above.

It will be understood that each of the elements described above, or two or more together, may also find a useful application in other types of constructions differing from the types described above.

While the invention has been illustrated and described as embodied in a screw, screwdriver, and screw-holding attachment therefor, it is not intended to be limited to the details shown, since various modifications and structural changes may be made without departing in any way from the spirit of the present invention. For example, each screw-gripping end portion 68, 70 need not be formed with a plurality of fingers 72, but instead each end portion 68, 70 could be formed as a one-piece curved portion without any splits or gaps therein. In this case, the one-piece screw-gripping end portion would have increased structural strength over the split-type end portion design.

It will be noted that the semi-dome shaped configuration of the screw-gripping end portions of either the split or the one-piece type, completely enclose the stem of the screw and also engage substantially the entire underside of the screw head to thereby hold the screw in a positive locking manner, thereby making the description "sure-grip" particularly applicable for the aforementioned screwdriver constructions.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended

1. A screw-holding screwdriver, comprising:

(a) an elongated driver shank having a longitudinal axis, a handle end region, and an opposite blade end region, (b) a driver blade of one-piece with the blade end region of the shank;

(c) means for holding a screw to be turned by the driver blade, said holding means including (1) a pair of movable elongated resilient arms at opposite sides of the driver shank, said arms being separated by two slots which extend lengthwise along the arms, each arm including (A) a screw-gripping end portion having a plurality of curved fingers which extend in smooth, continuous arcuate manner, both longitudinally away from the handle end region and radially inwardly towards the longitudinal axis to thereby form a generally semi-dome-shaped configuration, said fingers of both arms terminating at tips which define a circular periphery which surrounds the stem of the screw to be turned, said fingers of both arms engaging substantially the entire underside of the head of the screw to be turned to thereby hold the screw in a positive locking manner, said fingers of both arms being successively separated by radially-extending slits all of which have generally the same cross-sectional area along their lengths, (B) a semi-cylindrical body portion adjacent to each screw-gripping end portion, both of the semi-cylindrical portions extending circumferentially about the shank for partially enclosing the latter, each slot extending lengthwise along the semi-cylindrical body portions and having generally the same cross-sectional area along the lengths of the latter, (C) a generally flattened body portion adjacent to each semi-cylindrical body portion, both flattened body portions being located at opposite sides of the shank and having arcuate side edge regions which extend radially inwardly towards the longitudinal axis such that each slot has an enlarged cross-sectional area in the region of the flattened body portions, and (D) a semi-cylindrical collar end portion adjacent to each flattened body portion for partially enclosing the shank, and (2) means for moving the resilient arms between a non-gripping position in which the arms are spaced apart of each other, and a gripping position in which the screw-gripping end portions form a dome-shaped configuration and substantially enclose the screw head of the screw to be turned, said moving means constituting a cylindrical locking sleeve slidably mounted over the resilient arms for movement lengthwise of the latter, said locking sleeve having an interior passage formed with a leading axial end, a trailing axial end and an annular cam-type projection intermediate said axial ends of the passage, said projection being an annular ridge which extends radially inwardly from the inner circumferential wall of the passage, said ridge being in sliding frictional engagement with the body and end portions of the arms; and (d) means for finely and continuously adjusting the position of the holding means in longitudinal direction relative to the shank, said fine-adjusting means including (1) a mounting collar surrounding the arms and being fixedly connected to the collar end region of the arms for longitudinal movement with the same, said collar having a longitudinally-extending internally threaded collar portion adjacent to the handle end region, and a polygonally-shaped flange portion to facilitate manual gripping, and (2) a longitudinally-extending mating externally threaded shank portion of one-piece with the shank in the near vicinity of the handle end region for turning movement with the shank, said mating shank portion being in constant threaded engagement with the threaded collar portion during the entire turning movement of the driver shank for shifting the shank relative to the holding means with infinitely variable displacement.

2. The screwdriver as defined in claim 1 for holding a screw including (a) a threaded screw body having a longitudinal screw axis of symmetry; and (b) a screw head having wall means bounding a driver-engaging recess in the head, said wall means including (1) a pair of opposite side walls and respective wall edges at the top of the head, said wall edges extending transversely over the entire width of the head in generally parallel relationship to each other, said wall edges being spaced apart of each other at a predetermined transverse spacing to thereby form an open end at the top of the head, (2) a bottom wall which together with said side walls form a dovetail slot which extends over the entire width of the head, and (3) a longitudinally extending cavity which communicates with the dovetail slot at the bottom wall, said cavity having a cross-sectional dimension which extends transversely across the bottom wall for a distance less than the entire width of the head.

3. The screwdriver as defined in claim 2, wherein the driver blade is receivable in the recess and includes (a) an enlarged foot portion receivable in the slot, said foot portion having an axial end face, a pair of opposite major foot surfaces and a transverse thickness dimension between the latter at the axial end face, as measured in a plane substantially normal to the shank axis, (b) an anti-shift element of one-piece with and located axially adjacent to the foot portion, said element projecting from the axial end face in direction away from the handle end region along a pivot axis which is co-linear with the shank axis, (c) said transverse thickness dimension at the end face of the foot portion being of less magnitude than the predetermined transverse spacing of the open end of the screw head to thereby permit longitudinal insertion from above the latter through the open end thereof of the foot portion into the dovetail slot with clearance, so as to mount the foot portion for limited turning movement about the pivot axis relative to the slot, (d) said element being mountable in the cavity for limited turning movement relative to the latter about the pivot axis during said longitudinal insertion, (e) said axial end face engaging the bottom wall of the slot to thereby limit the depth of insertion of the element into the cavity, and (f) said foot surfaces of the foot portion sliding partially underneath and grippingly engaging the side walls of the slot in the head when the driver blade turns the element about the pivot axis.

* * * * *